United States Patent [19]

Pruett

[11] 4,135,989

[45] Jan. 23, 1979

[54] ELECTROLYTIC ETCHING OF TIN OXIDE FILMS

[75] Inventor: Barry B. Pruett, St. Petersburg, Fla.

[73] Assignee: E-Systems, Inc., Dallas, Tex.

[21] Appl. No.: 900,482

[22] Filed: Apr. 27, 1978

[51] Int. Cl.[2] ..... C25F 3/14; C25F 5/00

[52] U.S. Cl. ..... 204/129.1; 204/129.65; 204/129.75

[58] Field of Search ..... 204/129.1, 129.65, 129.75

[56] References Cited

U.S. PATENT DOCUMENTS

| | | | |
|---|---|---|---|
| 3,205,155 | 9/1965 | Van Natter | 204/129.65 X |
| 3,507,759 | 4/1970 | Shaw | 204/129.65 X |
| 3,616,349 | 10/1971 | Szupillo | 204/129.65 X |

FOREIGN PATENT DOCUMENTS

| | | | |
|---|---|---|---|
| 1260912 | 2/1968 | Fed. Rep. of Germany | 204/129.65 |
| 2541675 | 3/1977 | Fed. Rep. of Germany | 204/129.65 |
| 475955 | 12/1968 | Japan | 204/129.65 |

*Primary Examiner*—John H. Mack
*Assistant Examiner*—D. R. Valentine
*Attorney, Agent, or Firm*—Robert V. Wilder

[57] ABSTRACT

A method for etching tin oxide films from substrate materials is provided that includes the steps of forming an etching pattern layer of an active metal on the tin oxide film that is to be etched, contacting the active metal cathodically in an electrolytic solution, and subsequently contacting the active metal anodically in the electrolyte to thereby etch those portions of the tin oxide film that are covered by the etching pattern of active metal.

10 Claims, 3 Drawing Figures

ELECTROLYTIC ETCHING OF TIN OXIDE FILMS

FIELD OF THE INVENTION

This invention relates to a process for etching relatively thick coatings of tin oxide from non-conductive substrate materials. More particularly, this invention relates to a process for defining a pattern of electro conductive tin oxide on a non-conductive substrate by selectively etching unwanted portions of tin oxide film from the substrate employing a unique electrolytic process.

PRIOR ART

Tin oxide films, coated on non-conductive substrate materials, are employed in a wide range of applications including, for example, as resistor elements in the fabrication of thermal print heads. When tin oxide is employed in the fabrication of thermal print heads it is normally doped with antimony and has a film thickness in the order of 10,000 angstroms. Conventionally, the tin oxide films are formed over the entire face of a substrate non-conductive material and a pattern of the electrically resistant tin oxide is then formed by removing unwanted portions of the tin oxide film from the substrate. In the past, the selective removal of tin oxide films from substrate materials has been accomplished by air abrasion techniques wherein a masking element is placed over the tin oxide film leaving those portions of the film that are to be removed uncovered. The electro conductive coating of tin oxide is then sandblasted or subjected to similar abrasion techniques. Because of variations in the mask-film interface, and the amount of abrasion which takes place, some undercutting of the masked portions of the tin oxide coating frequently occurs causing the resultant pattern to have uneven edges, which in turn results in undesirable electrical properties in the remaining pattern of tin oxide. Until recently, etching procedures have not been employed to form a delineated pattern of tin oxide on a non-conductive substrate because the films of antimony doped tin oxides have a fairly high resistance to all known chemical etchants.

Therefore, a process whereby tin oxide, or antimony doped tin oxide, films can be selectively etched from non-conductive substrate surfaces to form electro conductive patterns thereon is highly desirable and would constitute an improvement over the abrasion removal methods currently in use.

SUMMARY OF THE INVENTION

According to the process of the subject invention tin oxide films may be etched from non-conductive substrate surfaces by forming a layer of an active metal on those portions of the tin oxide that are to be removed from the substrate, contacting the active metal cathodically in an electrolytic solution under conditions sufficient to cause a reaction between the tin oxide and the active metal, and then contacting the active metal anodically causing the active metal, and those portions of the tin oxide film which it covers, to be removed from the substrate material. The result is a non-conductive substrate material having a predetermined configuration of conductive tin oxide film thereon.

In another aspect, the process of the subject invention provides a method useful for defining tin oxide resistors for hybrid circuits, discrete resistors, and thermal print heads. The method of the present invention can be used to define resistors by etching relatively thick tin oxide films, formed by conventional chemical vapor deposition processes, on non-conductive substrate materials. According to the method of the present invention, an etching pattern of an active metal is formed on the tin oxide film such that upon contacting the active metal anodically in an electrolyte the active metal, and unwanted portions of the tin oxide coating, are removed from the non-conductive substrate. Various methods may be employed to define the etching pattern of the active metal such as: selective plating techniques; selective etching of an active metal coating that has been deposited over the entire surface of the tin oxide film; and, selective plating of noble metals over those portions of the tin oxide defining the desired conductive paths on the substrate so that upon plating the entire substrate surface with an active metal, and subsequently removing same, those portions not covered by the noble metal will be removed.

DESCRIPTION OF THE PREFERRED EMBODIMENT

Figure 1:
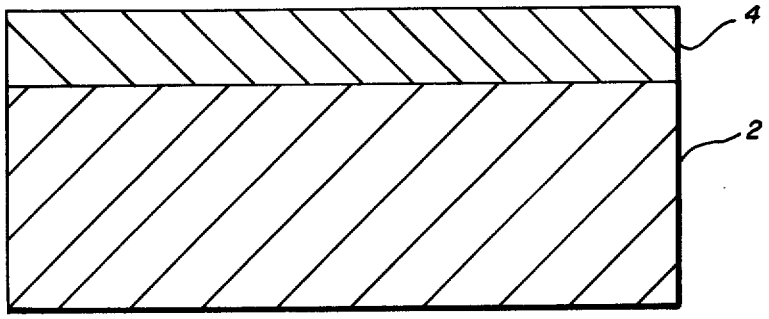
FIG. 1 is a cross-sectional view illustrating a tin oxide coated non-conductive substrate material useful in the process of the present invention.

As stated above, the process of the subject invention basically provides for an electrolytic method of etching tin oxides from non-conductive substrate members. Broadly, the first step of the process of the subject invention includes forming an etching pattern layer of an active metal on the tin oxide film that is desired to be etched away. The active metal coated tin oxide film is then contacted cathodically in the presence of a suitable electrolyte such that a reaction between the active metal and the tin oxide occurs. Subsequently, the active metal coated tin oxide film is contacted anodically in the presence of a suitable electrolyte to thereby cause the active metal on the surface thereof to be dissolved in the electrolyte, carrying with it those portions of the tin oxide film with which the active metal has previously been reacted.

The tin oxide film coated substrate members which can be etched by the process of the subject invention include substrate members formed from non-conductive materials, such as ceramic materials, for example, upon which tin oxide is coated by a conventional chemical vapor deposition process. Relatively thick tin oxide coatings have been difficult to etch using known chemical etching methods since only the top most portion of a tin oxide layer reacts with the etching chemicals. The process of the subject invention provides for etching of relatively thick tin oxide films which can be in the range of approximately 10,000 angstroms in thickness. Generally, such tin oxide films will have sheet resistivities of less than 200 ohms per square. Of course this method can be used on substantially thicker tin oxide film such as those exhibiting a resistivity of 20 to 30 ohms per square. Tin oxide films deposited on non-conductive substrate members are often doped with antimony in amounts ranging from 2 to about 30 percent by weight of the tin oxide employed. Tin oxide films doped with antimony can be etched according to the process of the subject invention.

The term "active metal" as used herein is defined as any metal which is capable of activating or catalyzing the electrolytic etching of the tin oxide. Iron and copper have demonstrated this capability. Other probable examples include zinc, magnesium and chromium. A preferred active metal is copper. These active metals can be formed into etching patterns on the tin oxide film in relatively small amounts, such as in amounts sufficient to form films of 20 to 50 micro inches in thickness.

The electrolytic solution employed in the process of the subject invention basically comprises a dilute aqueous solution of any acid or base which is capable of dissolving during electrolysis both tin and the active metal being used to remove selected portions of the tin oxide. Suggested examples include hydrochloric acid, nitric acid, sulfuric acid, acetic acid, sodium hydroxide and potassium hyroxide. Various other suitable electrolytes will be apparent to those of ordinary skill in the art. A preferred electrolyte is dilute hydrochloric acid in concentrations of about 1 part hydrochloric acid to about 4 parts water.

Now referring to the drawings, FIG. 1 represents a cross-section of a non-conductive substrate material 2 which carries a layer of tin oxide (or doped antimony tin oxide) 4 thereon.

Figure 2:
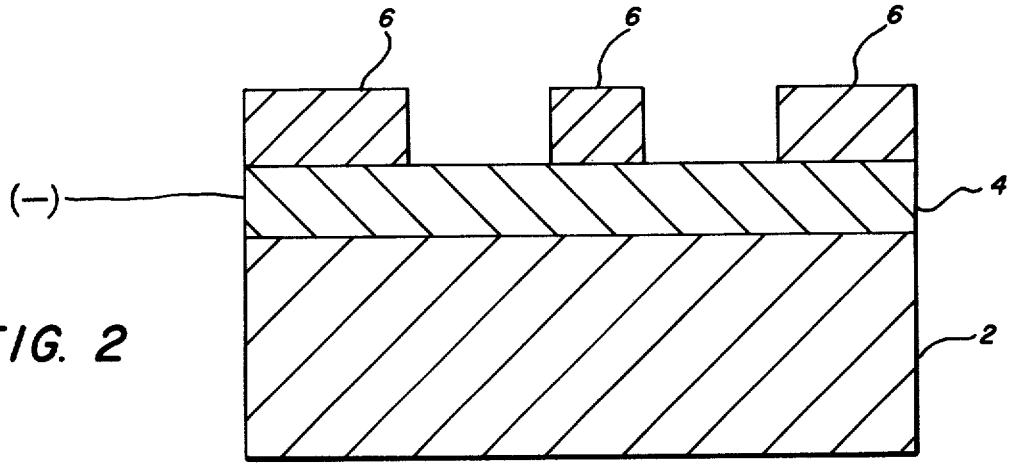
FIG. 2 is a cross-sectional view of a tin oxide coated substrate having an etching pattern layer of an active metal formed thereon in accordance with the process of the subject invention.

FIG. 2 depicts a cross-sectional view of the substrate and tin oxide layers onto which an active metal 6 has been deposited in order to form an etching pattern. The term "etching pattern" as used herein is defined as that configuration in which the active metal film is formed on the tin oxide film. Thus, upon removal of the active metal, and the portions of tin oxide covered thereby, the remaining layer of tin oxide on the non-conductive substrate member will be in a predetermined desired configuration. The etching pattern layer of active metal can be formed on the tin oxide film using any of a number of conventional pattern forming methods. For example, the active metal can be selectively plated onto the tin oxide using conventional types of selective plating techniques. It should be noted that when conventional plating techniques are employed the part is preferably lowered into the plating bath slowly in order to avoid uneven plating problems. In the alternative, photoresist technology or other selective etching technology can be employed by first coating the entire tin oxide film with the active metal and then selectively etching away those portions of the active metal so as to form the desired etching pattern of the active metal. Still another method for forming the desired etching pattern of the active metal on the layer of tin oxide is to first employ a third metal, such as gold or some other noble metal, by selectively plating the noble metal on those portions of the tin oxide which are not desired to be removed (that is, those portions defining the desired electroconductive path on the surface of the substate). The active metal layer of the subject invention can then be plated over the entire surface, and upon practicing the steps of the present invention, those portions of the tin oxide not covered by the noble metal will be removed resulting in the desired configuration of tin oxide on the substrate.

Once the etching pattern layer of the active metal has been formed on the tin oxide film, the process of the subject invention can be employed to selectively remove those portions of the tin oxide film covered by the etching pattern layer of the active metal. This is accomplished by immersing the part to be etched in an electrolyte and subjecting it to an electric current. The part is first made negative by cathodically contacting the active metal coated tin oxide layer until a reaction between the tin oxide and the active metal occurs. While the exact interaction of active metal and tin oxide which occurs when the part to be etched is charged negatively is not fully understood, it is believed that the tin oxide film is somehow activated so as to facilitate the etching thereof which is performed by the step set forth below. It should be noted that normally some visible signs of this reaction will occur, for example, color change and/or bubbling.

Once the part has been charged negatively it is removed from the electrolyte. The polarity is then reversed making the part positive. Thus, the tin oxide layer acts as an anode and the active metal, and those portions of the tin oxide covered thereby, are removed from the surface of the substrate material. It is preferably that the part be lowered slowly into the electrolyte as the tin oxide dissolves during this step of the process. For example, excellent results can be obtained when the piece is lowered into the electrolyte at a rate of approximately 1 inch per 5–30 seconds. The slow lowering allows the etching process to proceed in a manner such that electrical connection with the part is not interrupted.

Figure 3:
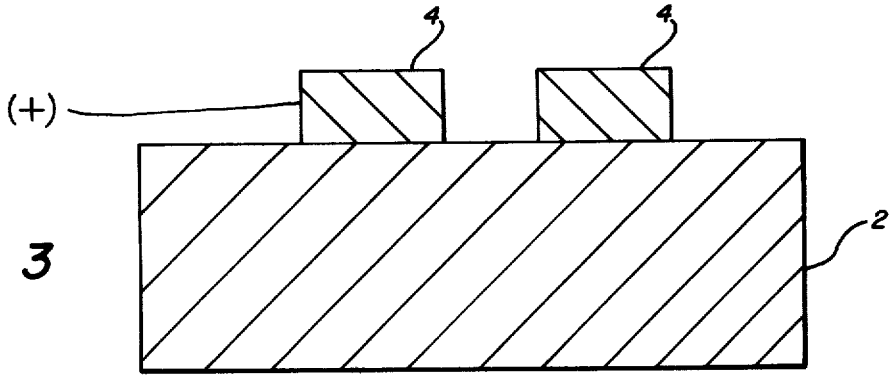
FIG. 3 is a cross-sectional view of a tin oxide coated substrate that has been etched according to the process of the subject invention.

FIG. 3 depicts a cross-sectional view of a non-conductive substrate member having a predetermined configuration of tin oxide film remaining thereon at the completion of the process.

Thus, according to the process of the subject invention relatively thick tin oxide films, that have heretofore been difficult to etch, can be electrolytically etched into predetermined configurations by the steps of (a) forming an etching pattern of an active metal on those portions of the tin oxide which are to be removed, (b) subjecting the part to an electric current with the tin oxide film acting as a cathode to thereby cause a reaction between the active metal etching pattern and the portions of the tin oxide covered thereby, and (c) subsequently reversing polarity so that the tin oxide acts as an anode causing the active metal, and those portions of the tin oxide which it covers, to dissolve into the electrolyte solution.

While this invention has been described in relation to its preferred embodiments, it is to be understood that various modifications thereof will be apparent to one skilled in the art upon reading the specification and it is intended to cover such modifications as fall within the scope of the appended claims.

I claim:

1. A process for the etching of tin oxide films from non-conductive substrate materials comprising:

(a) forming an etching pattern layer of an active metal on the tin oxide film to be etched;

(b) contacting said active metal coated tin oxide film cathodically in an electrolytic solution; and, (c) contacting said active metal coated tin oxide film anodically in said electrolytic solution to thereby etch the portion of said tin oxide film covered by said etching pattern of active metal from said substrate.

2. The process of claim 1 wherein said tin oxide film comprises tin oxide doped with antimony.

3. The process of claim 1 wherein said active metal is selected from the group consisting of copper, zinc, magnesium chromium and iron.

4. The process of claim 1 wherein said active metal is copper or iron.

5. The process of claim 1 wherein said electrolytic solution is selected from the group consisting of aqueous solutions of hydrochloric acid, nitric acid, sulfuric acid, acetic acid, sodium hydroxide and potassium hydroxide.

6. The process of claim 1 wherein said electrolytic solution comprises hydrochloric acid.

7. The process of claim 1 wherein said etching pattern of active metal is formed on the surface of said tin oxide film by selective plating.

8. The process of claim 1 wherein said etching pattern of active metal is formed on said tin oxide film by plating the entire tin oxide film with an active metal and then selectively etching said active metal to form said etching pattern.

9. The method of claim 1 wherein said etching pattern of active metal is formed on said tin oxide film by a process comprising:

(a) selectively plating a noble metal on that portion of the tin oxide which is not to be etched, and (b) plating the entire surface of said tin oxide film with an active metal.

10. A process for the etching of tin oxide film from non-conductive substrate materials coated with said film comprising:

(a) cathodically contacting said tin oxide film in the presence of an electrolyte to thereby react an etching pattern layer of active metal with the tin oxide film which is to be etched;

(b) removing said tin oxide film coated substrate from said electrolyte; and (c) lowering said substrate material into said electrolyte, while contacting said tin oxide film anodically, to thereby etch said etching pattern layer of active metal, and the tin oxide film reacted therewith, from said substrate material.

* * * * *